US006691930B2

(12) United States Patent
Lu

(10) Patent No.: US 6,691,930 B2
(45) Date of Patent: Feb. 17, 2004

(54) REEL ADAPTED TO BE USED WITH A HOSE WITH A CONNECTOR AND A SPRINKLER DETACHABLY CONNECTED TO THE CONNECTOR

(76) Inventor: Dau-Jen Lu, No. 124, Hsuehfu Rd., Taya Hsiang, Taichung Hsien (TW)

( * ) Notice: Subject to any disclaimer, the term of this patent is extended or adjusted under 35 U.S.C. 154(b) by 0 days.

(21) Appl. No.: 10/098,294

(22) Filed: Mar. 18, 2002

(65) Prior Publication Data

US 2003/0173417 A1 Sep. 18, 2003

(51) Int. Cl.[7] ..... B65H 75/00; B05B 7/02

(52) U.S. Cl. ..... 239/197; 239/195; 239/198; 239/526

(58) Field of Search ..... 239/195, 197, 239/198, 525, 526; 169/24, 25, 67; 242/397.3, 397.4, 395, 395.1, 379.1, 483.5, 277, 280, 281

(56) References Cited

U.S. PATENT DOCUMENTS

| | | | | |
|---|---|---|---|---|
| 1,322,604 | A | 11/1919 | Nuhring | |
| 2,519,064 | A | 8/1950 | Palm | |
| 3,484,979 | A | 12/1969 | Wansch | |
| 3,625,450 | A | 12/1971 | Lloyd | |
| 3,779,478 | A | 12/1973 | Fugate | |
| 3,869,096 | A | 3/1975 | Hogan et al. | |
| 4,195,794 | A | 4/1980 | Ricci et al. | |
| 4,200,249 | A | 4/1980 | Synstelien | |
| 4,220,293 | A | 9/1980 | Gename | |
| D260,985 | S | 9/1981 | Moylan | |
| 4,306,688 | A * | 12/1981 | Hechler, IV | 242/397 |
| 4,330,005 | A | 5/1982 | Kjarsgaard | |
| D270,996 | S | 10/1983 | Houghton | |
| 4,484,718 | A | 11/1984 | Jones-Fenleigh | |
| 4,531,686 | A | 7/1985 | Shaw | |
| 4,537,215 | A | 8/1985 | Roman | |
| 4,540,017 | A | 9/1985 | Prange | |
| 4,583,700 | A | 4/1986 | Tschurbanoff | |
| 4,586,676 | A | 5/1986 | Johnston et al. | |
| D286,610 | S | 11/1986 | Brusadin | |
| 4,748,937 | A | 6/1988 | Musetti | |
| D299,618 | S | 1/1989 | Drought et al. | |
| 5,014,925 | A * | 5/1991 | Cump | 242/405.3 |
| 5,782,412 | A * | 7/1998 | Plantz et al. | 239/197 |
| 5,826,608 | A | 10/1998 | Pierce | |
| 5,938,140 | A | 8/1999 | Fundak | |
| D431,179 | S | 9/2000 | Kovacik et al. | |
| 6,152,395 | A | 11/2000 | Corriveau et al. | |
| 6,224,038 | B1 | 5/2001 | Walsten et al. | |
| 2002/0020777 | A1 | 2/2002 | Cielker et al. | |

FOREIGN PATENT DOCUMENTS

| | | |
|---|---|---|
| JP | 1-214591 | 8/1989 |
| JP | 2-13578 | 1/1990 |

* cited by examiner

*Primary Examiner*—Davis Hwu
(74) *Attorney, Agent, or Firm*—Fei-Fei Chao; Venable LLP

(57) ABSTRACT

A reel is composed of a base having therein a recess, a seat formed on a bottom face defining the recess so as to position a rotation disk thereon, an opening defined in a side face defining the recess to communicate with the recess and for oppositely receiving two rollers, and a gap defined to communicate with the opening. The rotation disk has a first disk and a second disk securely connected to the first disk by means of a connection shaft. The second disk has an indent defined in a mediate portion thereof and a channel defined to communicate with both the indent and the opening of the base. The connector of the hose is able to be received in the indent and the hose is able to be wound around the connection shaft.

7 Claims, 6 Drawing Sheets

REEL ADAPTED TO BE USED WITH A HOSE WITH A CONNECTOR AND A SPRINKLER DETACHABLY CONNECTED TO THE CONNECTOR

BACKGROUND OF THE INVENTION

1. Field of the Invention

The present invention relates to a reel, and more particularly to a reel adapted to be used with a hose having a connector connected to a free end of the hose and a sprinkler detachably connected to the connector. The reel has a pair of rollers spatially and oppositely located with each other so as to expel residual water in the hose when being rolled up to be stored inside the reel and a stop pivotally mounted on an opening in a housing of the reel so as to prevent the hose from unintendedly uncoiling from the reel.

2. Description of Related Art

People often use a sprinkler to water the flowers and the lawn. After watering the flowers and the lawn, people always find it difficult and troublesome to sort out and store the tangled hose. Moreover, the water left in the hose not only causes the storage to be even more difficult, but also makes the storage place wet. Therefore, reels are invented to solve the tangle problem. One of the conventional reels (6) is shown in FIGS. 5 and 6, which has a base (60) and a cover (64) together with the base (60) to define therebetween a space (not numbered) to store the hose (50). The base (60) has a positioning ring (61) and a limiting ring (62) respectively formed on a side face of the base (60) so that a rotation disk (63) is able to be rotatably mounted between the positioning ring (61) and the limiting ring (62) and between the base (60) and the cover (64). A cutout (68) is defined in a peripheral edge of the rotation disk (63) to correspond to an opening (66) defined in the reel (6).

When this conventional reel (6) is to be stored after, the user first folds a small portion of the hose (50) and inserts the folded portion of the hose (50) into the cutout (68). Then, the user rotates the rotation disk (63) to roll up the hose (50) into the space inside the reel (6) until the entire length of the hose (50) is received in the reel (6).

However, after the entire length of the hose (50) is received in the reel (6), there is no room to store or to position the sprinkler head (52) or the connector (51) for the sprinkler (52), such that when the user is carrying the reel (6) from one place to another place, the weight of the connector (51) and the sprinkler head (52) would pull the hose (50) out of the reel (6), which causes the user trouble.

Furthermore, when the hose (50) is being pulled into the reel (6), the periphery of the hose (50) constantly engages with sides of the opening (66) and the friction therebetween reduces the life span of the hose (50).

Still, because there is not any auxiliary device attached to the reel (60) for positioning the sprinkler head (62) and/or the connector (61), the hose (50) is not secured inside the reel (6).

Another drawback of the conventional reel (6) is that the user will have to fold the hose (50) first, then insert the folded portion into the cutout (68), which is not convenient for the user.

To overcome the shortcomings, the present invention tends to provide an improved reel to mitigate and obviate the aforementioned problems.

SUMMARY OF THE INVENTION

The objective of the present invention is to provide an improved reel having a pair of rollers spatially and oppositely located with each other so as to expel residual water in the hose when being rolled up to be stored inside the reel and a stop pivotally mounted on an opening in a housing of the reel so as to prevent the hose from falling out of the reel.

In order to accomplish the foregoing objective, the reel is composed of a base having therein a recess, a seat formed on a bottom face defining the recess so as to position a rotation disk thereon, an opening defined in a side face defining the recess to communicate with the recess and for oppositely receiving two rollers, a gap defined to communicate with the opening. The rotation disk has a first disk rotatably seated on top of the seat, a second disk securely connected to the first disk by means of a connection shaft. The second disk has an indent defined in a mediate portion thereof and a channel defined to communicate with both the indent and the opening of the base.

With such an arrangement, the user is able to place the connector of the hose in the indent and the hose around the connection shaft. Then the user rotates the rotation disk to gradually roll up the entire length of the hose inside the recess. Finally, the sprinkler is able to be hung on a receiving recess defined in a side face of the base.

Other objects, advantages and novel features of the invention will become more apparent from the following detailed description when taken in conjunction with the accompanying drawings.

DETAILED DESCRIPTION OF THE PREFERRED EMBODIMENT

Figure 1:
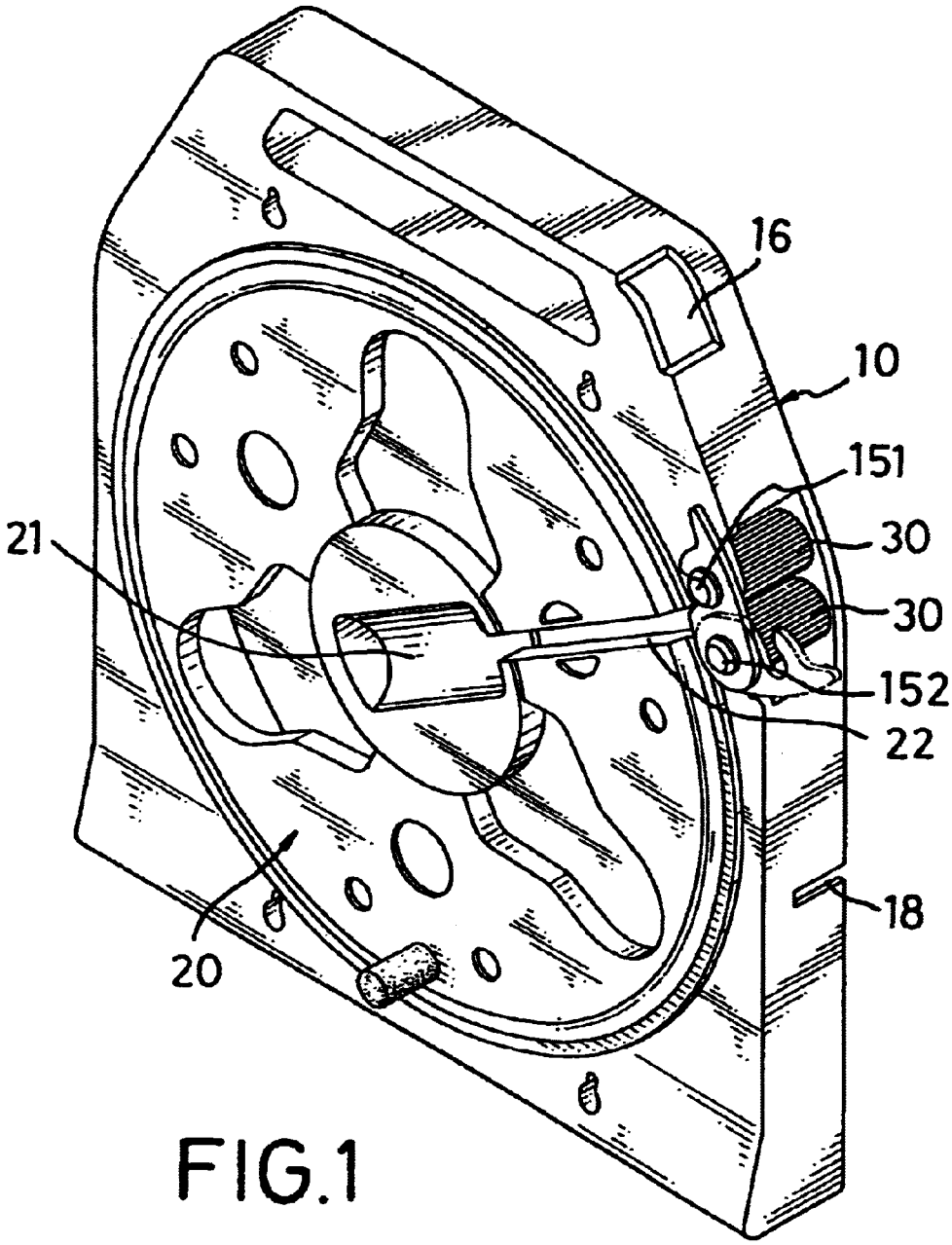
FIG. 1 is a perspective view of the reel of the present invention.
Figure 2:
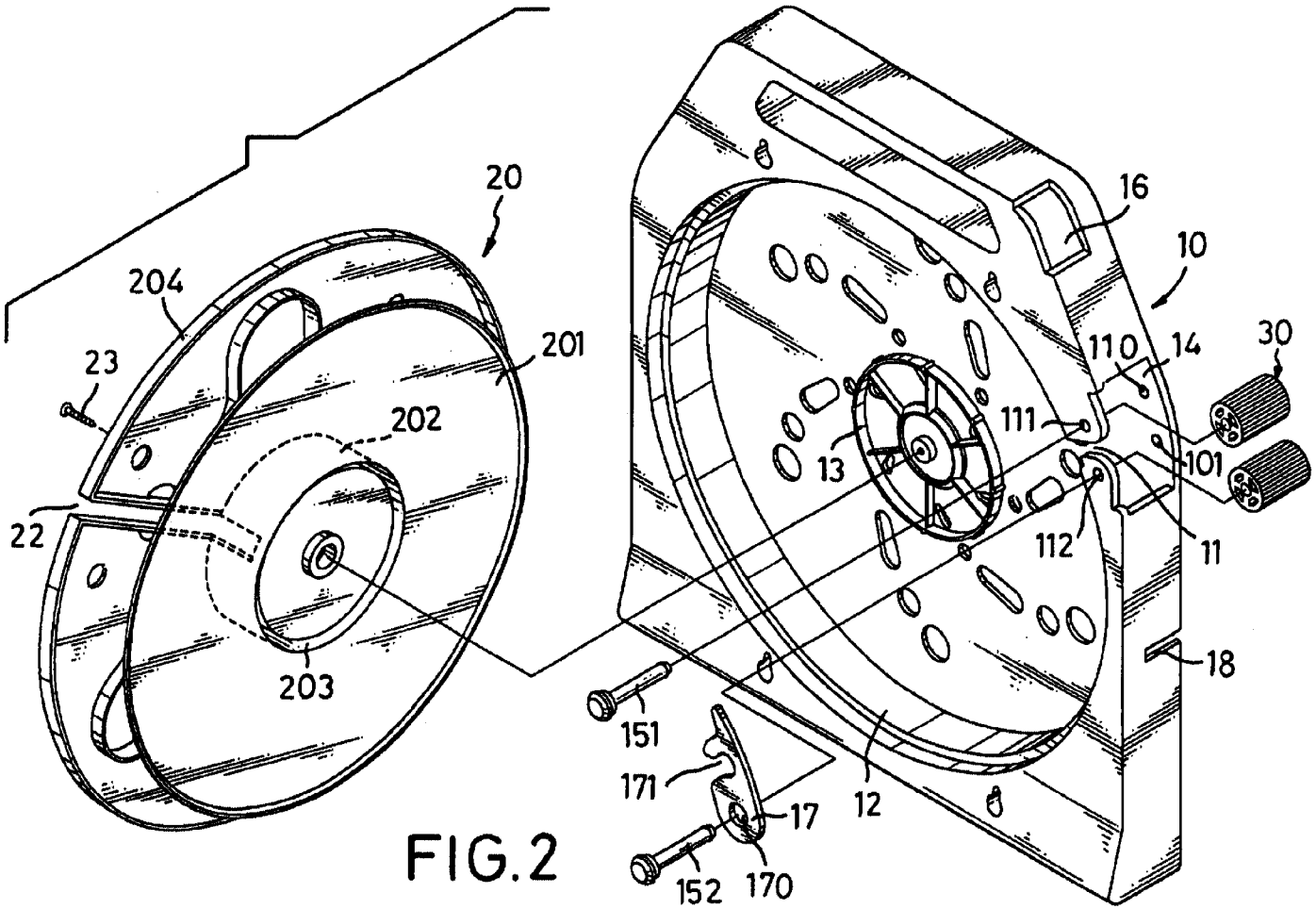
FIG. 2 is an exploded perspective view of the reel in FIG. 1.

With reference to FIGS. 1 and 2, the reel constructed in accordance with the present invention is composed of a base (10) and a rotation disk (20).

The base (10) is provided with a recess (12), a seat (13) formed on a bottom face defining the recess (12) so as to position the rotation disk (20) thereon, an opening (14) defined in a side face defining the recess (12) to communicate with the recess (12) and for oppositely receiving two rollers (30), and a gap (11) defined to communicate with the opening (14). A receiving recess (16) is defined in a top portion of the base (10) and a slit (18) is defined in the side face defining the recess (12), wherein the receiving recess (16), the opening (14) and the slit (18) are defined in the same side face of the base (10).

It is to be noted that two opposite edges defining the gap (11) respectively have a first through hole (111,112) and the bottom face of the base (10) has two second through holes (110,101) respectively corresponding and aligned to the two first through holes (111,112). A first shaft (151) and a second shaft (152) are able to extend through the aligned first and second through holes (111, 110)(112,101) so as to hold the two rollers (30) in the opening (14). That is, after entering the first holes (111,112) and before extending into the second through holes (110,101), the first and second shafts (151, 152) respectively extend through one of the rollers (30) and then extend into the second through holes (110,101). After the first and second shafts (151,152) extend through the two rollers (30), the two rollers (30) are able to rotate with respect to the first and second shafts (151,152). Furthermore, a stop (17) is pivotably mounted adjacent to the gap (11) so that the stop (17) is able to selectively close the communication of the gap (11) with the ambient air. The stop (17) has a hole (170) defined in a distal end thereof and a notch (171) defined in a side face thereof so that the second shaft (152) is able to extend through the hole (170) of the stop (17), the first through hole (112), one of the rollers (30) and into the second through hole (101), so that the stop (17) is pivotably relative to the second shaft (152).

The rotation disk (20) has a first disk (201) with an annular recess (203) defined in a face of the first disk (201) so that the first disk (201) is able to be rotatably seated on top of the seat (13) with a periphery of the seat (13) received in the annular recess (203) and via a screw (23) extending through a center of the rotation disk (20) and into a center of the seat (13), a second disk (204) securely connected to the first disk (201) by means of a connection shaft (202). The rotation disk (20) has an indent (21) defined in a mediate portion of the second disk (204) and an L-shaped channel (22) defined in a periphery of the second disk (204) and extending to a side face of the connection shaft (202). It is to be noted that the channel (22) communicates with an interior space between the first and the second disks (201, 204).

Figure 3:
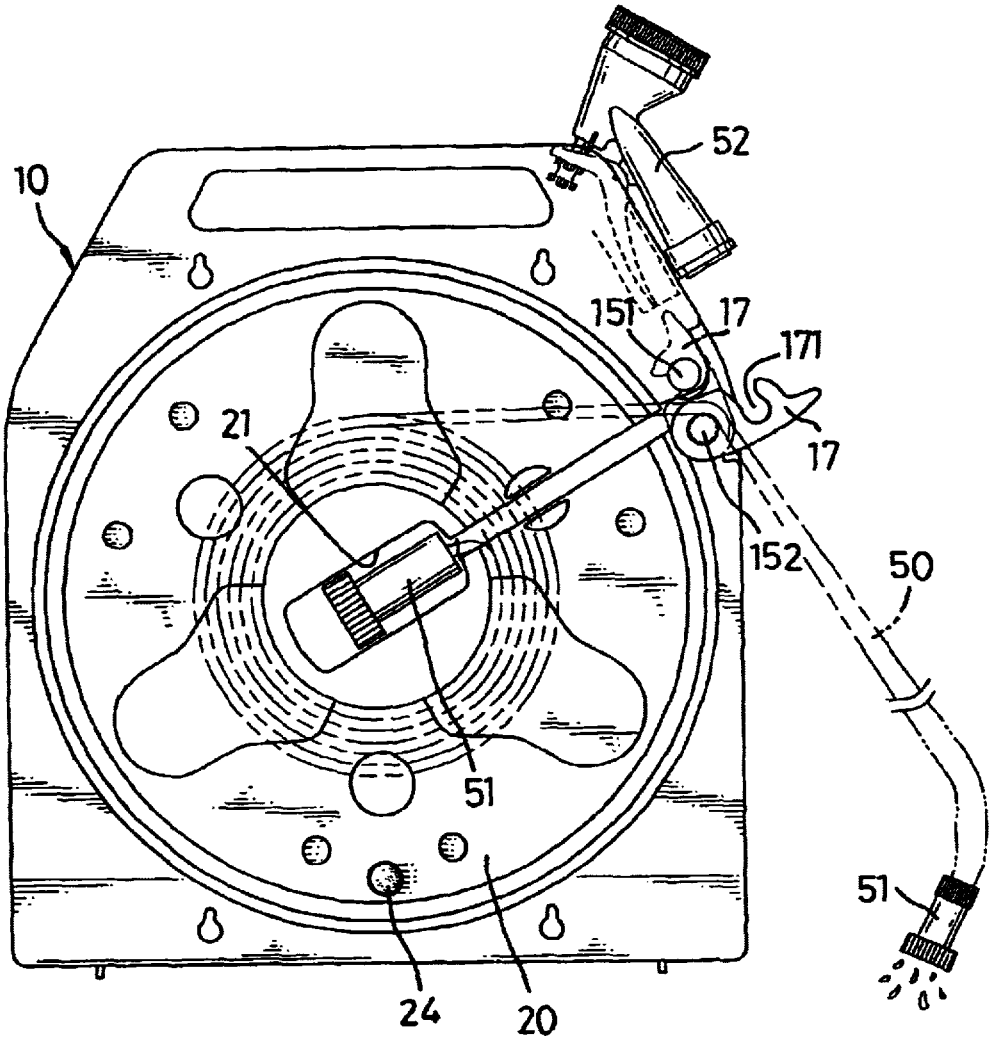
FIG. 3 is a schematic view showing that a hose with a sprinkler head and a connector for connecting the sprinkler head to the hose is stored in the reel.
Figure 4:
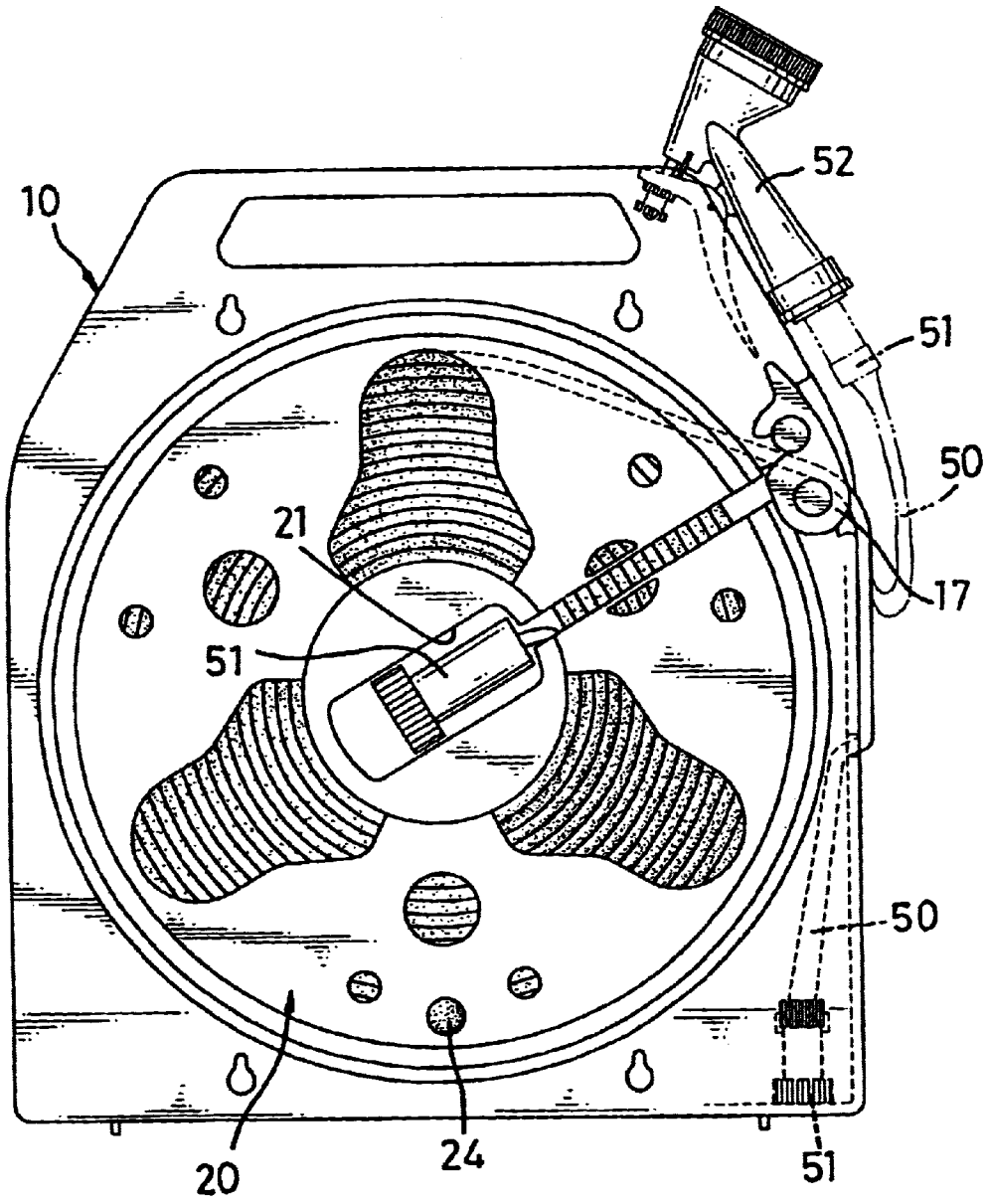
FIG. 4 is another embodiment of the reel of the present invention.
Figure 5:
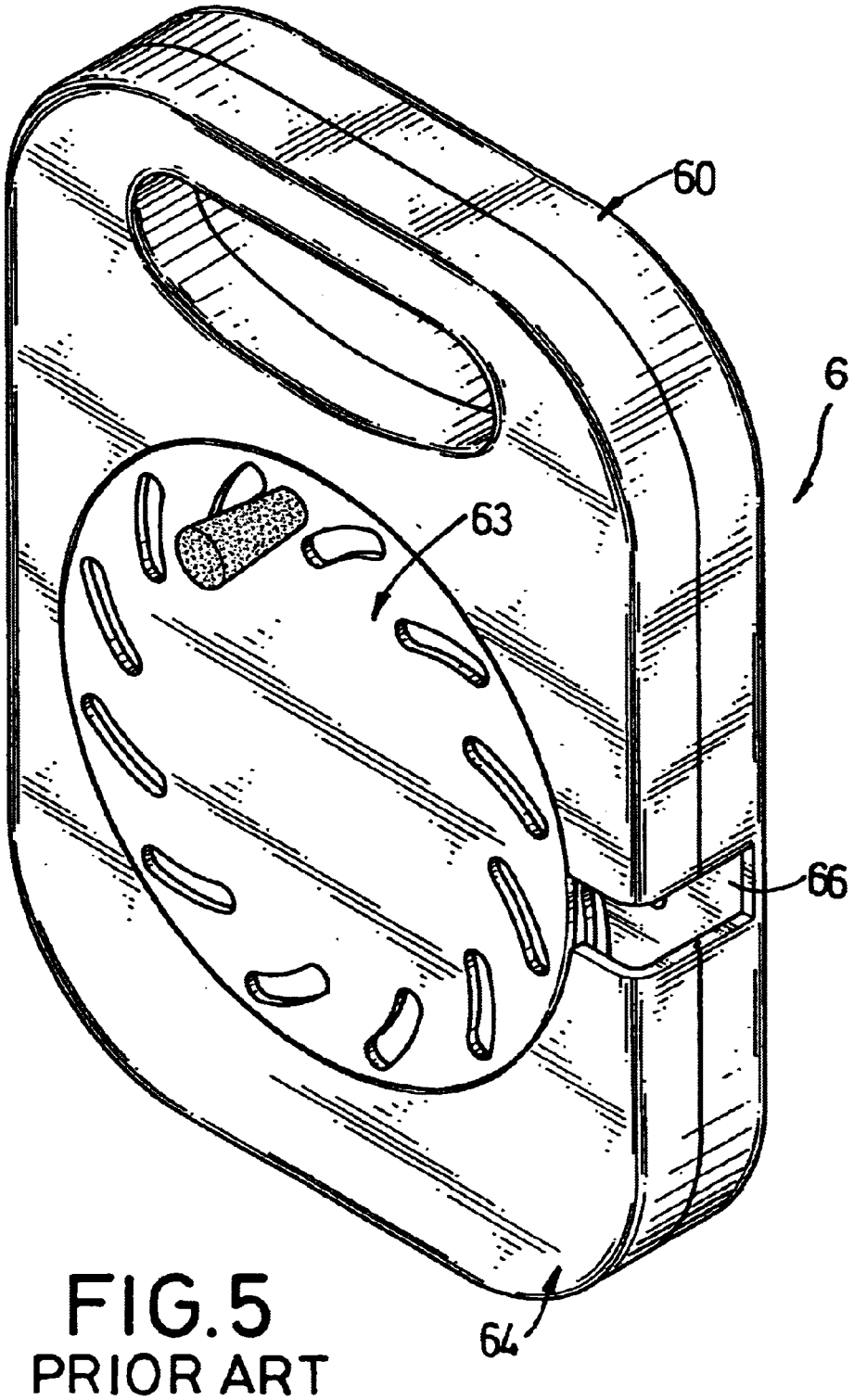
FIG.5 PRIOR ART
FIG. 5 is a perspective view of a conventional reel.
Figure 6:
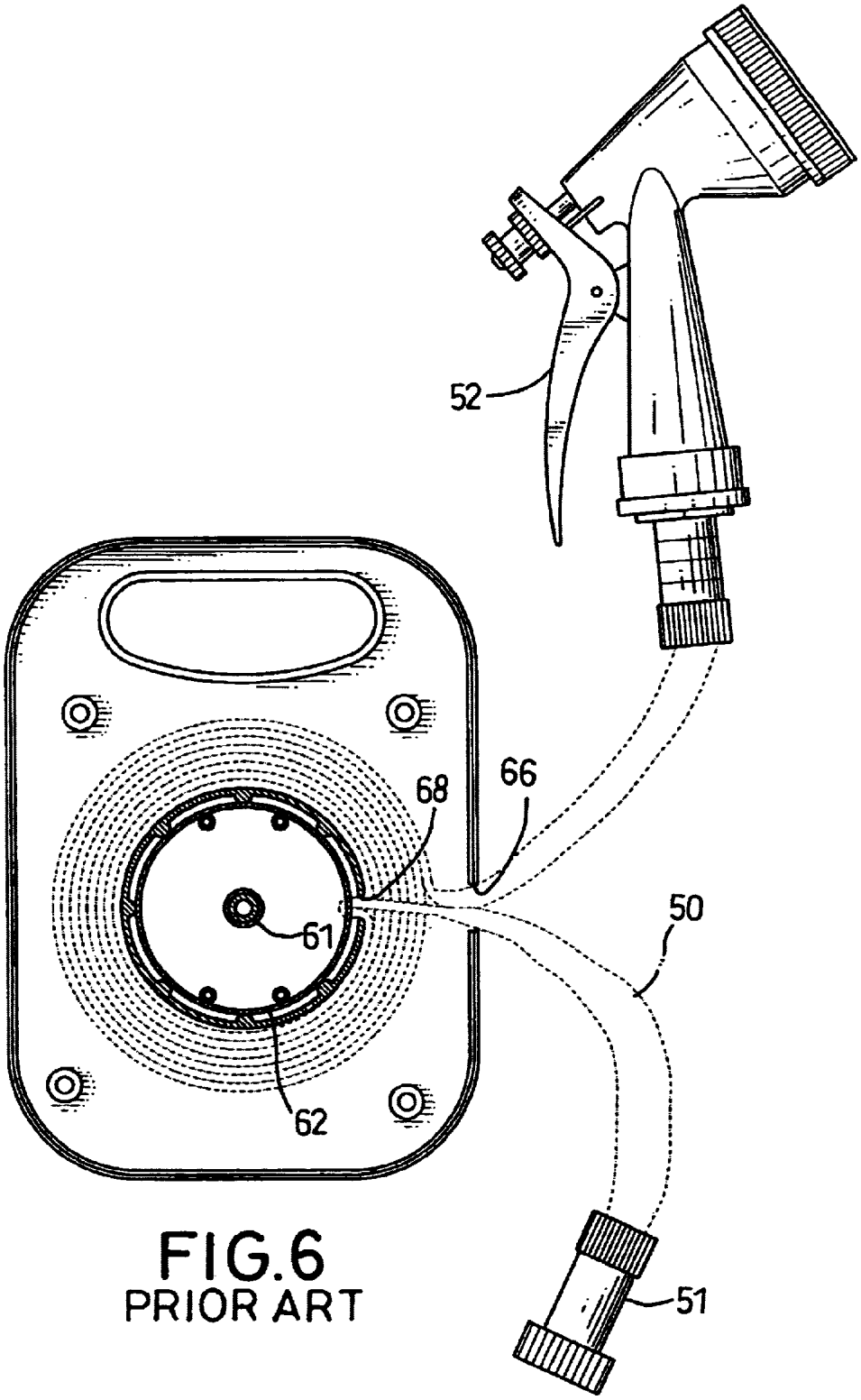
FIG.6 PRIOR ART
FIG. 6 is a schematic view showing that the conventional reel is used to store a hose with a sprinkler head and a connector for engaging the sprinkler head with the hose.

With reference to FIGS. 3 and 4, when the reel of the present invention is in use, the user places the connector (51) of the hose (50) in the indent (21) and then the user bends the hose (50) to insert the hose (50) in the channel (22). Thereafter, the user is able to use a cam (24) securely mounted on a face of the second disk (204) to rotate the rotation disk (20), such that the hose (50) is able to be rolled in the reel of the present invention. While the hose (50) is being rolled up in the reel, the hose (50) passes through a space between the two rollers (30) such that the residual water left in the hose (50) is able to be expelled by the two rollers (30). Further, when the entire length of the hose (50) is received in the connection shaft (202), the sprinkler head (52) is able to be securely seated in the receiving recess (16). However, when the sprinkler head (52) is removed and only the connector (51) for connecting the hose (50) to the sprinkler head (52) is still connected to the hose (50), the user is able to position the connector (51) by bending a portion of the hose (50) adjacent to the connector (51) and insert the hose in the slit (18). In order to prevent the hose (50) from falling out of the reel of the present invention, the stop (17) is able to engage with the first shaft (151) by mating the first shaft (151) with the notch (171), such that when the reel is carried around by the user holding a handle (100) provided on top of the reel, the hose (50), the sprinkler head (52) and the connector (51) are all secured in position relative to the reel.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A reel adapted to be used with a hose with a sprinkler head and a connector for connecting the hose to the sprinkler head, the reel comprising:

a base defining therein a recess, a seat formed on a bottom face defining the recess, an opening defined in a side face defining the recess to communicate with the recess so as to oppositely and rotatably receive therein a pair of rollers, a gap defined to communicate with the opening, a stop pivotally mounted to selectively close the communication between the gap and the opening; and a rotation disk rotatably mounted on the seat and having an indent defined in a face of the rotation disk and an L-shaped channel defined to allow a communication between the indent and the recess, whereby the connector is able to be received in the indent and the hose is bent to be received in the channel and the recess by rotating the rotation disk, the rollers are able to expel residual water left in the hose when the hose is being rolled up in the reel.

2. The reel as claimed in claim 1, wherein the base further has a receiving recess defined to adapt to receive therein the sprinkler head.

3. The reel as claimed in claim 2, wherein the base has a slit defined to receive therein a portion of the hose adjacent to the sprinkler head.

4. The reel as claimed in claim 1, wherein the rotation disk has a first disk rotatably connected to the seat and a second disk securely connected to the first disk via a connection shaft extending between the first and the second disks for winding the hose thereon.

5. The reel as claimed in claim 3, wherein the rotation disk has a first disk rotatably connected to the seat and a second disk securely connected to the first disk via a connection shaft extending between the first and the second disks for winding the hose thereon.

6. The reel as claimed in claim 1, wherein the base has a pair of aligned first through holes and a pair of aligned second through holes, which are defined to allow a first shaft and a second shaft to respectively extend through the first through holes and the second through holes.

7. The reel as claimed in claim 6, wherein the rollers are rotatably mounted on the first and second shafts.

* * * * *